US012540630B2

(12) United States Patent
Zhang et al.

(10) Patent No.: US 12,540,630 B2
(45) Date of Patent: Feb. 3, 2026

(54) FIRE PUMP FOR FIRE FIGHTING SYSTEM

(71) Applicants: Wenling Fluid Machinery Technology Institute of Jiangsu University, Taizhou (CN); Jiangsu University, Zhenjiang (CN); Taizhou Vocational College of Science & Technology, Taizhou (CN)

(72) Inventors: Jinfeng Zhang, Taizhou (CN); Puyu Cao, Taizhou (CN); Zhenhua Shen, Taizhou (CN); Chao Wang, Taizhou (CN); Guidong Li, Zhenjiang (CN)

(73) Assignees: Wenling Fluid Machinery Technology Institute of Jiangsu University, Taizhou (CN); Jiangsu University, Zhenjiang (CN); Taizhou Vocational College of Science & Technology, Taizhou (CN)

( * ) Notice: Subject to any disclaimer, the term of this patent is extended or adjusted under 35 U.S.C. 154(b) by 0 days.

(21) Appl. No.: 18/605,517

(22) Filed: Mar. 14, 2024

(65) Prior Publication Data

US 2025/0163933 A1 May 22, 2025

(30) Foreign Application Priority Data

Apr. 28, 2023 (CN) ..... 202310477562.4

(51) Int. Cl.
*F04D 29/44* (2006.01)
*F04D 1/00* (2006.01)
(Continued)

(52) U.S. Cl.
CPC ..... *F04D 29/448* (2013.01); *F04D 1/00* (2013.01); *F04D 27/001* (2013.01); *F04D 29/22* (2013.01)

(58) Field of Classification Search
CPC ..... F04D 29/448; F04D 1/00; F04D 27/001; F04D 29/22
See application file for complete search history.

(56) References Cited

U.S. PATENT DOCUMENTS 3,006,603 A * 10/1961 Caruso ..... F01D 5/043 415/119
3,873,231 A * 3/1975 Callahan ..... D21F 1/00 415/208.4

(Continued)

FOREIGN PATENT DOCUMENTS

| | | |
|---|---|---|
| CN | 110159538 A | 8/2019 |
| CN | 113236607 A | 8/2021 |
| CN | 113775533 A | 12/2021 |

*Primary Examiner* — Andrew J Marien
(74) *Attorney, Agent, or Firm* — George D. Morgan

(57) ABSTRACT

The present invention discloses a fire pump for a fire fighting system, the fire pump including a pump body (1), a motor (2), a transmission assembly (3), a water inlet pipe (4), a water outlet pipe (5), and a display instrument (6). The pump body is a centrifugal pump, and the pump body includes a volute, an impeller (11), and a diffuser (12). The impeller includes a plurality of blades (13) distributed along a circumferential direction, and the diffuser includes a plurality of guide blades (14) distributed along a circumferential direction, where the diffuser has a geometric center O1, the impeller has a geometric center O2, and the geometric center O1 and the geometric center O2 are not concentric and have a deviation (Y1, X1); and the plurality of guide blades of the diffuser are distributed along the circumferential direction at unequal intervals.

5 Claims, 4 Drawing Sheets

(51) Int. Cl.
*F04D 27/00* (2006.01)
*F04D 29/22* (2006.01)

(56) References Cited

U.S. PATENT DOCUMENTS

| | | | | | |
|---|---|---|---|---|---|
| 4,253,800 | A * | 3/1981 | Segawa | F04D 29/662 | 416/500 |
| 5,165,849 | A * | 11/1992 | Nakagawa | F04D 29/462 | 415/161 |
| 10,954,960 | B2 * | 3/2021 | Wang | F04D 29/462 | |
| 11,190,079 | B2 * | 11/2021 | You | H02K 5/24 | |
| 12,025,156 | B1 * | 7/2024 | Wang | F04D 29/669 | |
| 2022/0196026 | A1 * | 6/2022 | Hokey | F04D 29/22 | |

* cited by examiner

FIRE PUMP FOR FIRE FIGHTING SYSTEM

CROSS-REFERENCE TO RELATED APPLICATIONS

The application claims priority to Chinese patent application No. 2023104775624, filed on Apr. 28, 2023, the entire contents of which are incorporated herein by reference.

TECHNICAL FIELD

The present invention relates to the technical field of fire fighting systems, and in particular relates to a fire pump for a fire fighting system.

BACKGROUND

As shown in FIG. 1 and FIG. 2, an existing fire pump for a fire fighting system includes a pump body 1, a motor 2, a bearing box or a transmission assembly 3, a water inlet pipe 4, a water outlet pipe 5, and a display instrument 6. The pump body 1 is connected to the motor 2 through the transmission assembly 3, an inlet end of the pump body 1 is connected to the water inlet pipe 4, an outlet end of the pump body 1 is connected to the water outlet pipe 5, the display instrument 6 and a control valve are connected to the water outlet pipe 5, the display instrument 6 includes a pressure gauge and/or a flow meter, the pump body 1 is a centrifugal pump, and the pump body 1 includes a volute, an impeller 11, and a diffuser 12. The impeller 11 is mounted in the volute, a rotating shaft of the impeller 11 is connected to the motor 2 through the transmission assembly 3, the diffuser 12 is located at a radial outer periphery of the impeller 11, the diffuser 12 is disposed in the volute, the impeller 11 includes a plurality of blades 13 distributed along a circumferential direction, and the diffuser 12 includes a plurality of guide blades 14 distributed along a circumferential direction. The diffuser 12 has a geometric center O1, the impeller 11 has a rotation center/geometric center O2, the geometric center O1 and the geometric center O2 are concentric or coincide. However, pressure loss of the existing fire pump in a volute cavity is relatively large, and in particular, pressure loss of a lower part of the volute cavity is relatively large, which causes problems that hydraulic performance of the fire pump decreases and pumping efficiency decreases.

SUMMARY

A purpose of the present invention is to overcome disadvantages in the prior art, and provide a fire pump for a fire fighting system. A geometric center O1 of a diffuser and a geometric center O2 of an impeller are not concentric and have a deviation, and/or a plurality of guide blades are distributed along a circumferential direction of the diffuser at unequal intervals, specifically, an interval G1 is greater than an interval G2, and a number N1 of the guide blades is less than a number N2 of the guide blades, so that pressure loss in a volute cavity can be reduced, output pressure and hydraulic performance of the fire pump/centrifugal pump can be improved, and therefore water pumping efficiency of the fire pump can be improved.

In order to realize the purposes mentioned above, the present invention adopts the following technical solution:

a fire pump for a fire fighting system, including a pump body (1), a motor (2), a transmission assembly (3), a water inlet pipe (4), a water outlet pipe (5), and a display instrument (6), where the pump body is connected to the motor through the transmission assembly, an inlet end of the pump body is connected to the water inlet pipe, an outlet end of the pump body is connected to the water outlet pipe, the display instrument and a control valve are connected to the water outlet pipe, the display instrument includes a pressure gauge and/or a flow meter, the pump body is a centrifugal pump, and the pump body includes a volute, an impeller (11), and a diffuser (12), where the impeller is mounted in the volute, a rotating shaft of the impeller is connected to the motor through the transmission assembly, the diffuser is located at a radial outer periphery of the impeller, the diffuser is disposed in the volute, the impeller includes a plurality of blades (13) distributed along a circumferential direction, and the diffuser includes a plurality of guide blades (14) distributed along a circumferential direction, where the diffuser (12) has a geometric center O1, the impeller (11) has a geometric center O2, and the geometric center O1 and the geometric center O2 are not concentric and have a deviation (Y1, X1).

Further, an X-Y coordinate system is established through the geometric center O1 of the diffuser (12), an X-axis is in a transverse direction, a Y-axis is in a vertical direction, and the deviation is a downward offset Y1 along the vertical direction, that is, an offset Y1 along a negative direction of the Y-axis.

Further, the guide blades (14) include a plurality of guide blades, and the plurality of guide blades are distributed along a circumferential direction of the diffuser (12) at unequal intervals.

Further, the guide blades (14) include first guide blades (141) and second guide blades (142), the plurality of first guide blades are disposed substantially on a lower half of the diffuser, that is, the plurality of first guide blades are disposed substantially on the negative direction of the Y-axis of the diffuser (12); the plurality of second guide blades are disposed substantially on an upper half of the diffuser, that is, the plurality of second guide blades are disposed substantially on a positive direction of the Y-axis of the diffuser.

Further, adjacent first guide blades (141) have an interval G1 along the circumferential direction, and a number of the first guide blades is N1; and adjacent second guide blades (142) have an interval G2 along the circumferential direction, and a number of the second guide blades is N2, where G1 is greater than G2, and N1 is less than N2.

Further, the circumferential interval G1 is 1.2 to 3 times as large as G2.

Further, N1 is an odd number or an even number, N2 is an odd number or an even number, N2 is (2K±1) times as large as N1, where K is an integer.

Further, an X-Y coordinate system is established through the geometric center O1 of the diffuser (12), an X-axis is in a transverse direction, a Y-axis is in a vertical direction, and the deviation is a downward offset Y1 along the vertical direction, that is, an offset Y1 along a negative direction of the Y-axis, and a leftward offset X1 along the transverse direction, that is, an offset X1 along a negative direction of the X-axis.

Further, Y1 is 1 to 4 times as large as X1.

Further, the blade (13) is an arc-shaped blade, the blade is a backward blade, and the guide blade (14) is an arc-shaped guide blade.

According to the fire pump for a fire fighting system of the present invention, the geometric center O1 of the diffuser and the geometric center O2 of the impeller are not concentric and have a deviation, and/or the plurality of guide blades are distributed along the circumferential direction of the diffuser at unequal intervals, specifically, the interval G1 is greater than the interval G2, and the number N1 of the guide blades is less than the number N2 of the guide blades, so that pressure loss in a volute cavity (mainly a lower part of the volute cavity) can be reduced, output pressure and hydraulic performance of the fire pump/centrifugal pump can be improved, and therefore water pumping efficiency of the fire pump can be improved.

Figure 1:
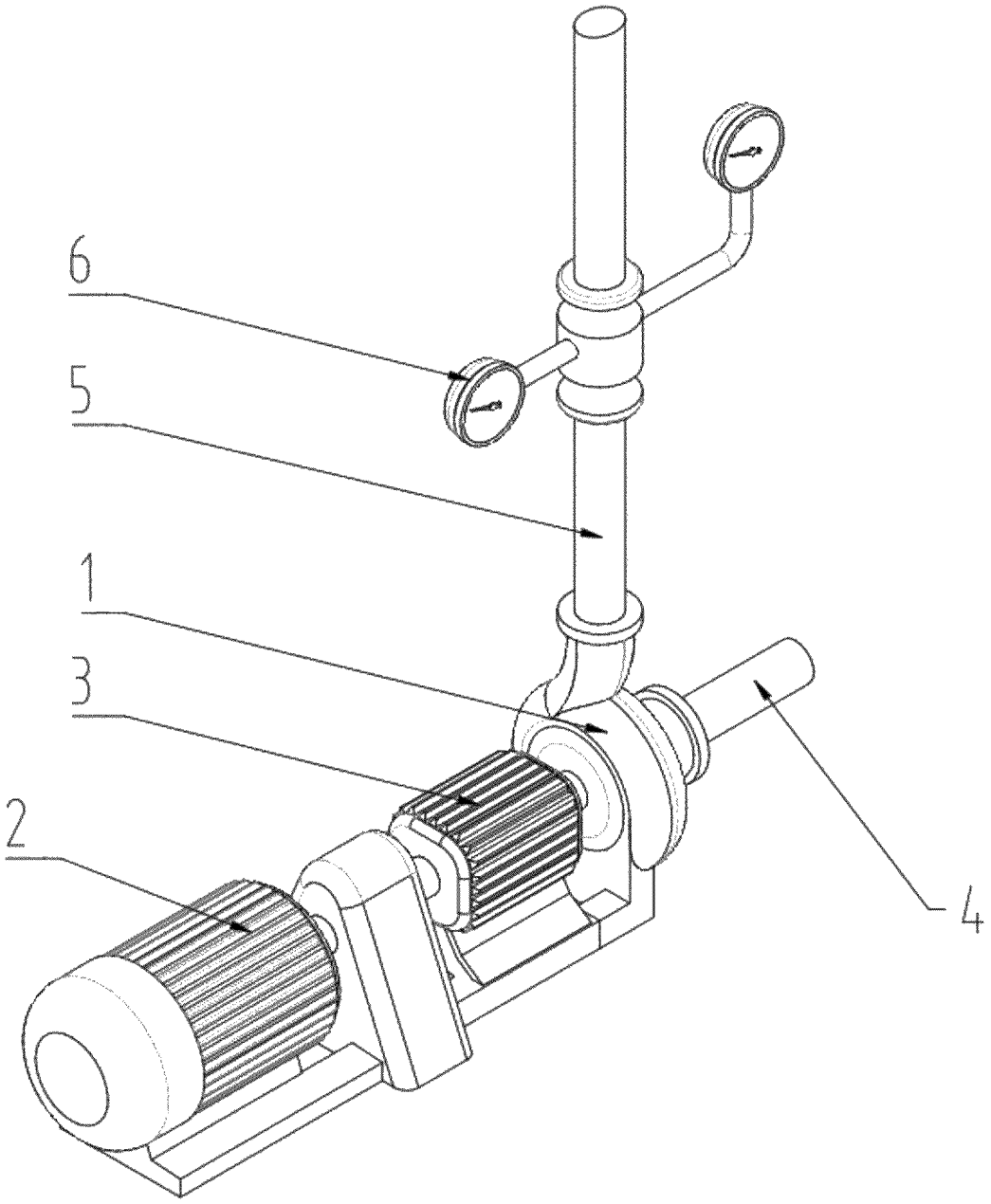
FIG. 1 is a schematic structural diagram of a fire pump in the prior art.

In the drawings: pump body 1, motor 2, bearing box or transmission assembly 3, water inlet pipe 4, water outlet pipe 5, display instrument 6, impeller 11, diffuser 12, blade 13, guide blade 14, first guide blade 141, second guide blade 142.

DETAILED DESCRIPTION OF THE EMBODIMENTS

To make the objectives, technical solutions, and advantages of the embodiments of the present invention clearer, the following clearly and completely the technical solutions in the embodiments of the present invention with reference to the accompanying drawings in the embodiments of the present invention. Apparently, the described embodiments are some but not all of the embodiments of the present invention. All other embodiments obtained by a person of ordinary skill in the art based on the embodiments of the present invention without creative efforts shall fall within the protection scope of the present invention.

The following describes the present invention in detail with reference to the accompanying drawings.

Figure 2:
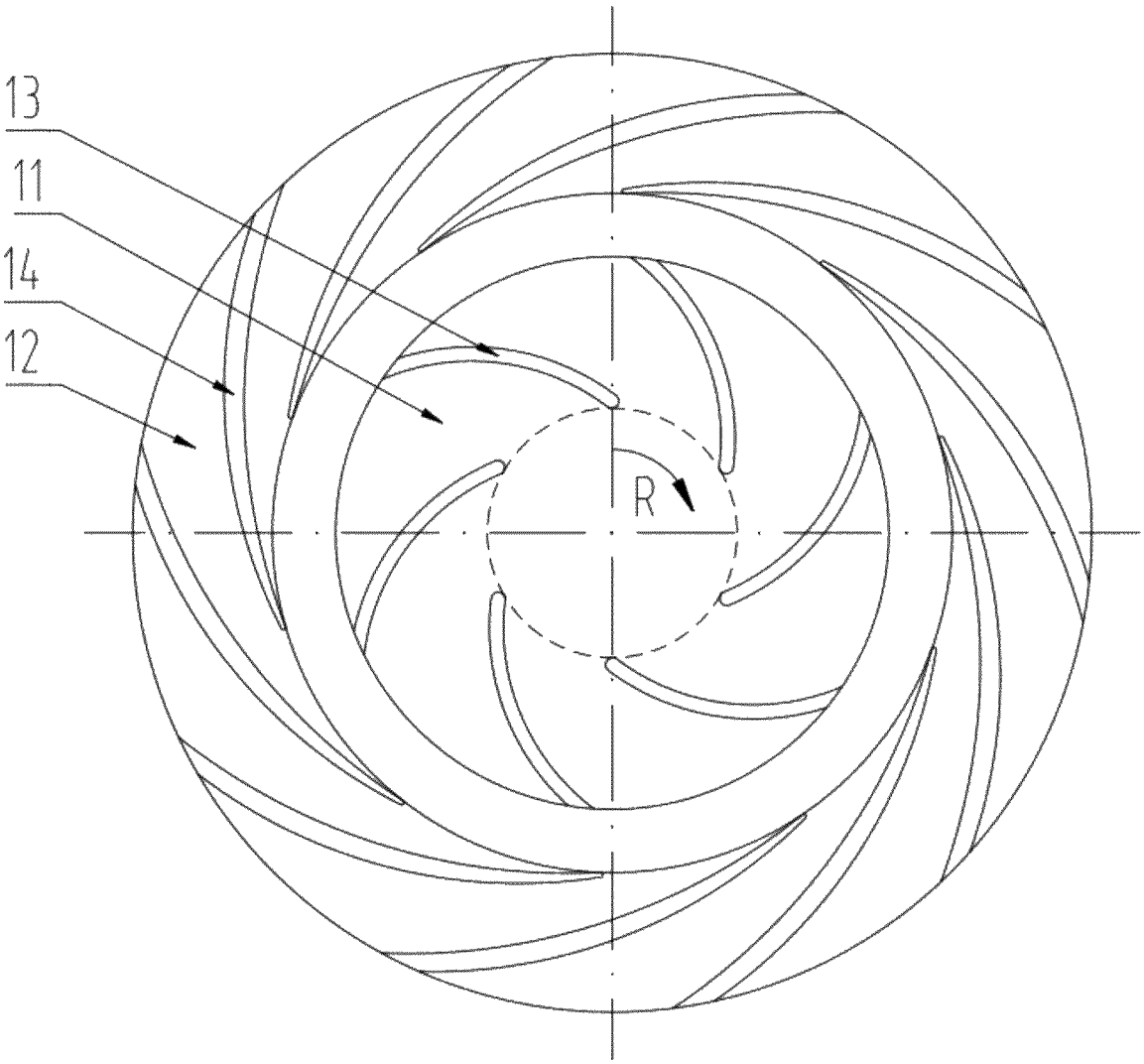
FIG. 2 is a schematic structural diagram of a pump body in the prior art.
Figure 3:
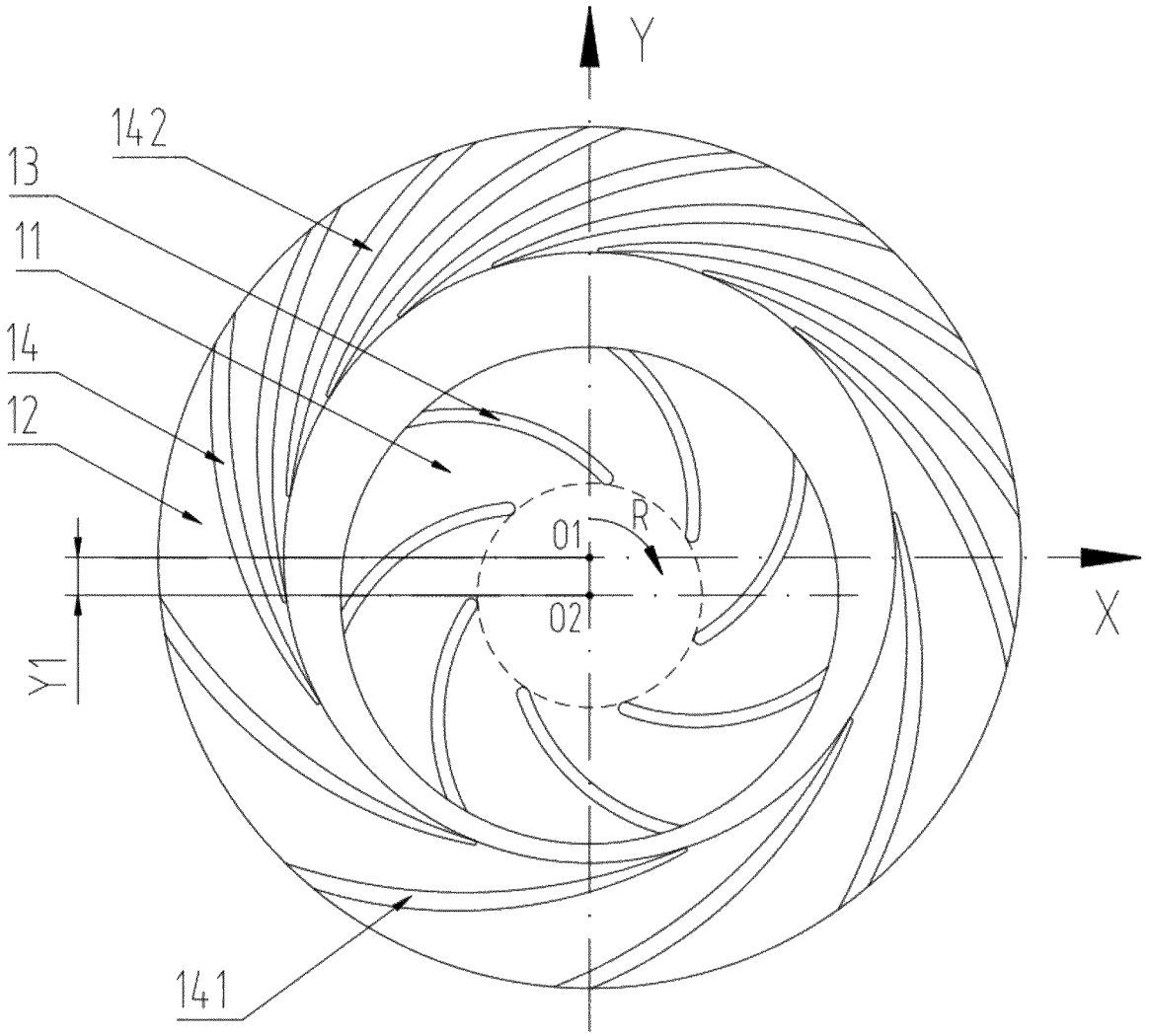
FIG. 3 is a schematic structural diagram of an embodiment of a pump body according to the present invention.
Figure 4:
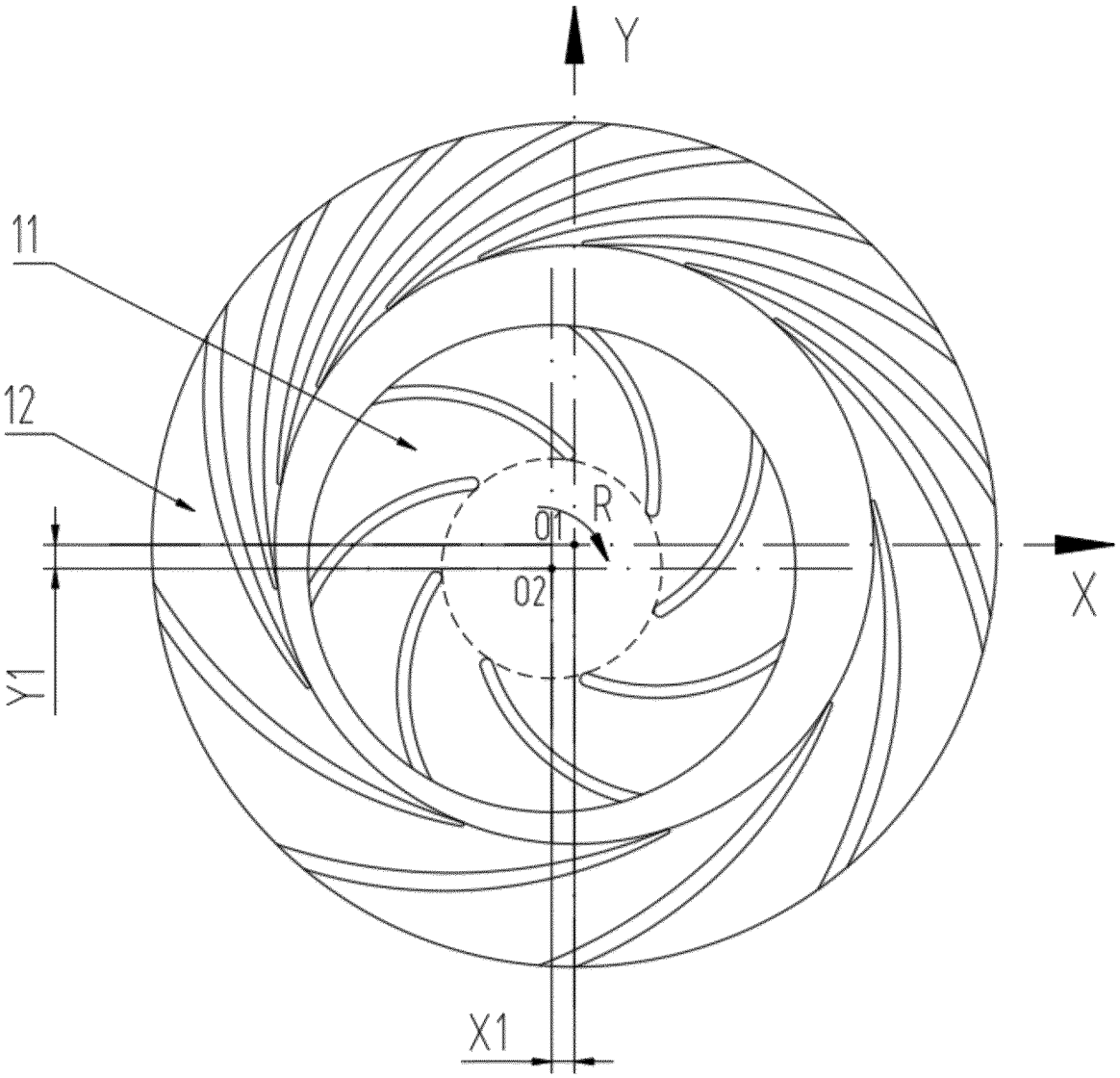
FIG. 4 is a schematic structural diagram of another embodiment of a pump body according to the present invention.

As shown in FIG. 1 to FIG. 4, a fire pump for a fire fighting system includes a pump body 1, a motor 2, a bearing box or a transmission assembly 3, a water inlet pipe 4, a water outlet pipe 5, and a display instrument 6. The pump body 1 is connected to the motor 2 through in the transmission assembly 3, an inlet end of the pump body 1 is connected to the water inlet pipe 4, an outlet end of the pump body 1 is connected to the water outlet pipe 5, the display instrument 6 and a control valve are connected to the water outlet pipe 5, the display instrument 6 includes a pressure gauge and/or a flow meter, the pump body 1 is a centrifugal pump, and the pump body 1 includes a volute, an impeller 11, and a diffuser 12. The impeller 11 is mounted in the volute, a rotating shaft of the impeller 11 is connected to the motor 2 through the transmission assembly 3, the diffuser 12 is located at a radial outer periphery of the impeller 11, the diffuser 12 is disposed in the volute, the impeller 11 includes a plurality of blades 13 distributed along a circumferential direction, and the diffuser 12 includes a plurality of guide blades 14 distributed along a circumferential direction. The diffuser 12 has a geometric center O1, the impeller 11 has a rotation center/geometric center O2, and the geometric center O1 and the geometric center O2 are not concentric and have a deviation (Y1, X1).

Further, an X-Y coordinate system is established through the geometric center O1 of the diffuser 12, an X-axis is in a transverse direction, a Y-axis is in a vertical direction, and the deviation is a downward offset Y1 along the vertical direction, that is, an offset Y1 along a negative direction of the Y-axis.

The guide blades 14 include a plurality of guide blades, and the plurality of guide blades are distributed along a circumferential direction of the diffuser 12 at unequal intervals. According to the fire pump for a fire fighting system of the present invention, the geometric center O1 of the diffuser 12 and the geometric center O2 of the impeller 11 are not concentric and have a deviation, and/or the plurality of guide blades are distributed along the circumferential direction of the diffuser 12 at unequal intervals, so that pressure loss in a volute cavity (mainly a lower part of the volute cavity) can be reduced, output pressure and hydraulic performance of the fire pump/centrifugal pump can be improved, and therefore water pumping efficiency of the fire pump can be improved.

Further, the guide blades 14 include first guide blades 141 and second guide blades 142, the plurality of first guide blades 141 are disposed substantially on a lower half of the diffuser 12, that is, the plurality of first guide blades 141 are substantially disposed on the negative direction of the Y-axis of the diffuser 12; the plurality of second guide blades 142 are disposed substantially on a upper half of the diffuser 12, that is, the plurality of second guide blades 142 are disposed substantially on a positive direction of the Y-axis of the diffuser 12.

Adjacent first guide blades 141 have an interval G1 along the circumferential direction, and a number of the first guide blades is N1; and adjacent second guide blades 142 have an interval G2 along the circumferential direction, and a number of the second guide blades is N2, where G1 is greater than G2, and N1 is less than N2.

The circumferential interval G1 is 1.2 to 3 times as large as G2, and preferably, G1 is 1.6 to 2.4 times as large as G2.

N1 is an odd number or an even number, preferably an odd number, and N2 is an odd number or an even number, preferably an odd number; N2 is (2K±1) times as large as N1, where K is an integer.

In the present invention, the first guide blades 141 and the second guide blades 142 are designed as followed: specifically, the interval G1 is greater than the interval G2, and the number N1 of the guide blades is less than the number N2 of the guide blades, so that pressure loss in a volute cavity (mainly a lower part of the volute cavity) can be further reduced, output pressure and hydraulic performance of the fire pump/centrifugal pump can be improved, and therefore water pumping efficiency of the fire pump can be improved.

In another embodiment, an X-Y coordinate system is established through the geometric center O1 of the diffuser 12, an X-axis is in a transverse direction, a Y-axis is in a vertical direction, and the deviation is a downward offset Y1 along the vertical direction, that is, an offset Y1 along a negative direction of the Y-axis, and a leftward offset X1 along the transverse direction, that is, an offset X1 along a negative direction of the X-axis. Y1 is 1 to 4 times as large as X1, and preferably, Y1 is 1 to 2 times as large as X1.

The blade 13 is an arc-shaped blade, the blade 13 is a backward blade, and the guide blade 14 is an arc-shaped guide blade.

According to the fire pump for a fire fighting system of the present invention, the geometric center O1 of the diffuser 12 and the geometric center O2 of the impeller 11 are not concentric and have a deviation, and/or the plurality of guide blades are distributed along the circumferential direction of the diffuser 12 at unequal intervals, specifically, the interval G1 is greater than the interval G2, and the number N1 of the guide blades is less than the number N2 of the guide blades, so that pressure loss in a volute cavity (mainly a lower part of the volute cavity) can be reduced, output pressure and hydraulic performance of the fire pump/centrifugal pump can be improved, and therefore water pumping efficiency of the fire pump can be improved.

It should be noted that, in the embodiments of the present invention, all directional indications (such as up, down, left, right, front, back, horizontal, and vertical) are merely used to explain a relative position relationship, a motion situation, and the like between components in a specific gesture (as shown in the accompanying drawings). If the specific gesture changes, the directional indication changes accordingly. The "connection" may be a direct connection, or may be an indirect connection, and the "disposed", "disposed in", and "disposed on" may be disposed directly, or may be disposed indirectly.

The foregoing embodiments are a description of the present invention, and are not intended to limit the present invention. It should be understood that, various changes, modifications, replacements and variations can be made to these embodiments without departing from the principle and spirit of the present invention. The scope of protection of the present invention is defined by the appended claims and their equivalents.

What is claimed is:

1. A fire pump for a fire fighting system, comprising a pump body (1), a motor (2), a transmission assembly (3), a water inlet pipe (4), a water outlet pipe (5), and a display instrument (6), wherein the pump body is connected to the motor through the transmission assembly, an inlet end of the pump body is connected to the water inlet pipe, an outlet end of the pump body is connected to the water outlet pipe, the display instrument and a control valve are connected to the water outlet pipe, the display instrument comprises a pressure gauge and/or a flow meter, the pump body is a centrifugal pump, and the pump body comprises a volute, an impeller (11), and a diffuser (12), wherein the impeller is mounted in the volute, a rotating shaft of the impeller is connected to the motor through the transmission assembly, the diffuser is located at a radial outer periphery of the impeller, the diffuser is disposed in the volute, the impeller comprises a plurality of blades (13) distributed along a circumferential direction, and the diffuser comprises a plurality of guide blades (14) distributed along a circumferential direction, wherein the diffuser (12) has a geometric center O1, the impeller (11) has a geometric center O2, and the geometric center O1 and the geometric center O2 are not concentric and have a deviation (Y1, X1);

an X-Y coordinate system is established through the geometric center O1 of the diffuser (12), an X-axis is in a transverse direction, a Y-axis is in a vertical direction, and the deviation is a downward offset Y1 along the vertical direction, that is, an offset Y1 along a negative direction of the Y-axis; the plurality of guide blades are distributed along a circumferential direction of the diffuser (12) at unequal intervals; the plurality of guide blades (14) comprise a plurality of first guide blades (141) and a plurality of second guide blades (142), the plurality of first guide blades are disposed on a lower half of the diffuser, that is, the plurality of first guide blades are disposed on the negative direction of the Y-axis of the diffuser (12); the plurality of second guide blades are disposed on an upper half of the diffuser, that is, the plurality of second guide blades are disposed on a positive direction of the Y-axis of the diffuser; adjacent first guide blades (141) have an interval G1 along the circumferential direction, and a number of the first guide blades is N1; and adjacent second guide blades (142) have an interval G2 along the circumferential direction, and a number of the second guide blades is N2, wherein the interval G1 is greater than the interval G2, and the number of the first guide blades N1 is less than the number of the second guide blades N2; and the interval G1 is 1.2 to 3 times as large as the interval G2.

2. The fire pump for the fire fighting system according to claim 1, wherein the number of the first guide blades N1 is an odd number or an even number, and the number of the second guide blades N2 is an odd number or an even number, the number of the second guide blades N2 is (2K±1) times as large as the number of the first guide blades N1, wherein K is a natural number.

3. The fire pump for the fire fighting system according to claim 2, wherein the deviation is further a leftward offset X1 along the transverse direction, that is, an offset X1 along a negative direction of the X-axis.

4. The fire pump for the fire fighting system according to claim 3, wherein the offset Y1 is 1 to 4 times as large as the offset X1.

5. The fire pump for the fire fighting system according to claim 3, wherein the blades of the plurality of blades (13) are arc-shaped blades, the blades of the plurality of blades are backward blades, and the guide blades of the plurality of guide blade (14) are arc-shaped guide blades.

* * * * *